US010465401B2

(12) United States Patent
Berry et al.

(10) Patent No.: US 10,465,401 B2
(45) Date of Patent: Nov. 5, 2019

(54) CONSTRUCTION SAFETY NET SUPPORT APPARATUS

(71) Applicant: Ronald A. Bullock, San Francisco, CA (US)

(72) Inventors: Jason L. Berry, San Francisco, CA (US); Ronald A. Bullock, San Francisco, CA (US)

( * ) Notice: Subject to any disclaimer, the term of this patent is extended or adjusted under 35 U.S.C. 154(b) by 0 days.

(21) Appl. No.: 14/933,780

(22) Filed: Nov. 5, 2015

(65) Prior Publication Data

US 2016/0305138 A1 Oct. 20, 2016

Related U.S. Application Data

(60) Provisional application No. 62/148,057, filed on Apr. 15, 2015.

(51) Int. Cl.
*E04G 21/32* (2006.01)
*E04G 11/28* (2006.01)

(52) U.S. Cl.
CPC ..... *E04G 21/3266* (2013.01); *E04G 21/32* (2013.01); *E04G 11/28* (2013.01); *E04G 21/3247* (2013.01)

(58) Field of Classification Search
CPC .. E04G 11/28; E04G 3/20; E04G 3/28; E04G 5/04; E04G 5/046; E04G 21/3247; E04G 21/3266; E04G 21/32; E04G 21/3204; E04G 21/3261; E04G 11/30; E04G 2003/286; E04G 3/30; E04G 3/32; E04G 3/325; E04G 5/001
USPC ..... 249/18–22; 425/63, 65; 264/33; 182/222, 223, 186.6, 152, 178.1, 82, 87
See application file for complete search history.

(56) References Cited

U.S. PATENT DOCUMENTS 2,893,786 A * 7/1959 Faye ..... E04G 3/20 182/229
3,252,199 A * 5/1966 Bossner ..... E04B 31/3505 182/128
3,520,383 A * 7/1970 Loock ..... A63B 27/00 182/133
3,583,666 A * 6/1971 Horstketter ..... E04G 11/28 249/10
3,779,678 A * 12/1973 Scheller ..... E04G 11/22 425/65

(Continued)

FOREIGN PATENT DOCUMENTS

WO WO 2004020766 A1 * 3/2004 ..... B66F 1/08

*Primary Examiner* — Daniel P Cahn
(74) *Attorney, Agent, or Firm* — Dergosits & Noah LLP; Todd A. Noah

(57) ABSTRACT

A support apparatus for a construction safety net. A frame is configured with a length sufficient to span at least two floors of a building under construction, and a width defined by parallel vertical support posts. Pairs of mounting brackets are affixed at or near the edges of adjacent exposed floors of the building. Each mounting bracket has a channel portion extending beyond the edge of the respective floor and aligned with the channel portions of mounting brackets affixed on adjacent floors. The vertical support posts of the frame are movable through the vertical channels and can be lifted up into the next pair of channel portions as additional floors are built out. A locking mechanism is used to secure the vertical support posts to the brackets.

11 Claims, 9 Drawing Sheets

(56) References Cited

U.S. PATENT DOCUMENTS 3,991,969 A * 11/1976 Oxyer ..... B28B 7/02 249/10
4,040,774 A * 8/1977 Scheller ..... E04G 11/28 249/20
4,060,358 A * 11/1977 Fougea ..... E04G 3/24 182/128
4,290,576 A * 9/1981 Schworer ..... E04G 11/28 249/20
4,397,441 A * 8/1983 Manderla ..... E04G 11/28 249/19
4,540,150 A * 9/1985 Tzincoca ..... E04G 11/28 249/20
4,562,989 A * 1/1986 Scheller ..... E04G 11/28 249/17
4,611,784 A * 9/1986 Gallis ..... E04G 5/04 182/82
4,809,814 A * 3/1989 St-Germain ..... E04G 1/20 182/118
4,838,382 A * 6/1989 Nusbaum ..... E04G 21/3266 182/138
4,856,615 A * 8/1989 Nusbaum ..... E04G 21/3261 182/82
4,917,346 A * 4/1990 Mathis ..... E04G 11/28 249/153
4,962,828 A * 10/1990 Duncan ..... E04G 21/3223 182/82
5,000,287 A * 3/1991 Schwo/ rer ..... E04G 11/28 182/136
5,259,479 A * 11/1993 St-Germain ..... E04G 1/20 182/146
5,299,654 A * 4/1994 Duncan ..... E04G 21/3266 182/138
5,579,865 A * 12/1996 Butler ..... B66B 9/02 182/141
7,581,709 B2 * 9/2009 Gillespie ..... E04G 11/38 249/19
9,175,487 B2 * 11/2015 Iturbe Beristain ..... E04G 21/16
9,476,210 B2 * 10/2016 Urzelai Ezkibel ..... E04G 11/28
9,528,285 B2 * 12/2016 Blinn ..... E04G 21/3266
9,963,889 B2 * 5/2018 Shen ..... E04G 3/32
2003/0052249 A1 * 3/2003 Waldschmitt ..... E04G 11/28 249/20
2005/0217934 A1 * 10/2005 Choo ..... E04G 3/28 182/82
2007/0119116 A1 * 5/2007 Arozena Bergaretxe ..... E04G 11/28 52/633
2008/0257644 A1 * 10/2008 Schwoerer ..... E04G 11/24 182/142
2009/0146041 A1 * 6/2009 Schwoerer ..... E04G 11/20 249/20
2009/0173574 A1 * 7/2009 Hobmeier ..... E04G 11/28 182/82
2010/0038518 A1 * 2/2010 Schwoerer ..... E04G 11/28 249/20
2010/0212237 A1 * 8/2010 Schwoerer ..... E04G 11/28 52/122.1
2011/0171336 A1 * 7/2011 Schwoerer ..... E04G 11/28 425/63
2012/0168251 A1 * 7/2012 Baxter ..... B66C 23/205 182/129
2012/0247870 A1 * 10/2012 Iturbe Beristain ..... E04G 21/3247 182/82
2013/0168626 A1 * 7/2013 Blinn ..... E04G 21/3266 256/31
2014/0102829 A1 * 4/2014 Stearns ..... A62B 1/22 182/139
2015/0152658 A1 * 6/2015 Rosati ..... E04G 21/3247 182/222
2018/0038122 A1 * 2/2018 Blinn ..... E04G 21/3247

* cited by examiner

FIG. 6A
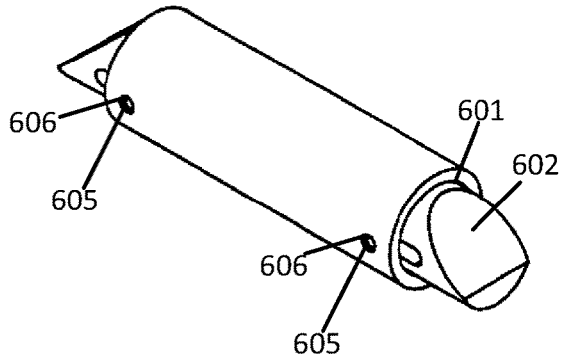
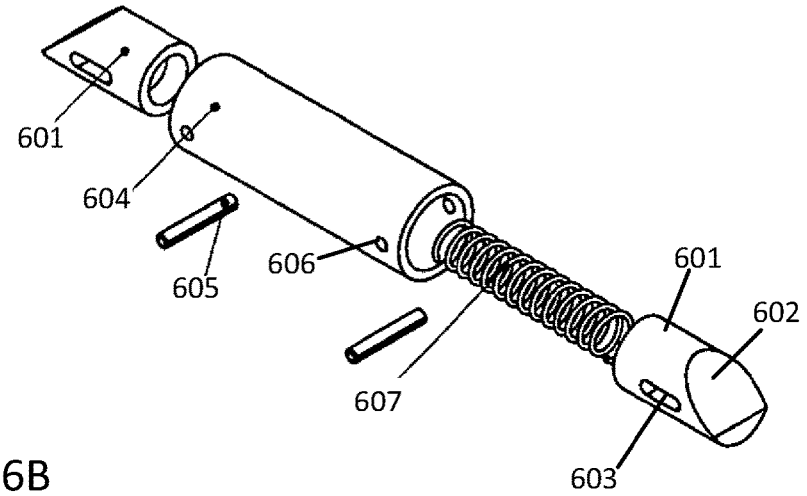
FIG. 6B

CONSTRUCTION SAFETY NET SUPPORT APPARATUS

CROSS REFERENCE

This disclosure claims the priority benefit of U.S. Provisional Patent App. No. 62/148,057 entitled Customizable Safety Debris Net, filed Apr. 15, 2015, the entire disclosure of which is incorporated herein by reference.

TECHNICAL FIELD

This disclosure relates generally to the field of construction, and more specifically, to an apparatus for supporting a safety net for use on building construction projects.

BACKGROUND

Safety nets are commonly used on construction projects to provide a containment device for personnel and debris that may fall from a building under construction. Further, such safety netting is required when construction workers are exposed to vertical drops of more than six feet. Federal regulations for worker safety (see 29 C.F.R. § 1910 et seq.) are promulgated and enforced by the Occupational Safety & Health Administration ("OSHA"), a part of the U.S. Department of Labor, and OSHA-approved state agencies, such as Cal/OSHA, which is part of the Department of Industrial Relations for the State of California.

However, current techniques for providing safety nets on the job site typically involve first installing the safety net structures to service the lower floors of a building under construction, then breaking down and removing the safety net structures, and then completely reinstalling one or more safety net structures on higher level floors for each portion of the building as additional floors are built out. This activity results in significant time and expense for every high-rise construction project.

Thus, it would be desirable to avoid or minimize such costly efforts, for example, by providing a safety net apparatus that could readily be raised up to higher floors during construction without having to be completely removed, disassembled and reinstalled.

BRIEF DESCRIPTION OF THE DRAWINGS

FIG. 6A is a perspective view of a locking mechanism used with the frame and mounting bracket, and FIG. 6B is an exploded perspective view of the locking mechanism.

DETAILED DESCRIPTION

This disclosure describes an apparatus having a frame for supporting a construction safety net, wherein the frame is capable of being fixed in position with a plurality of mounting brackets, but is also capable of being moved upward through the mounting brackets to service higher floors of a building under construction. A method for using the safety net support apparatus for construction projects is also described.

It is noted that a safety net apparatus for a particular construction project must meet the OSHA minimum requirements for vertical distance to the horizontal plane of the net, horizontal distance to the outer edge of the net, and drop-testing a load, among others. Thus, the frame and mounting brackets described herein require a specification of materials that will meet at least the minimum OSHA requirements. Engineering calculations for the specification are considered routine for those with ordinary skill in this technology, and therefore are not described herein, but illustrative examples are provided.

Figure 1A:
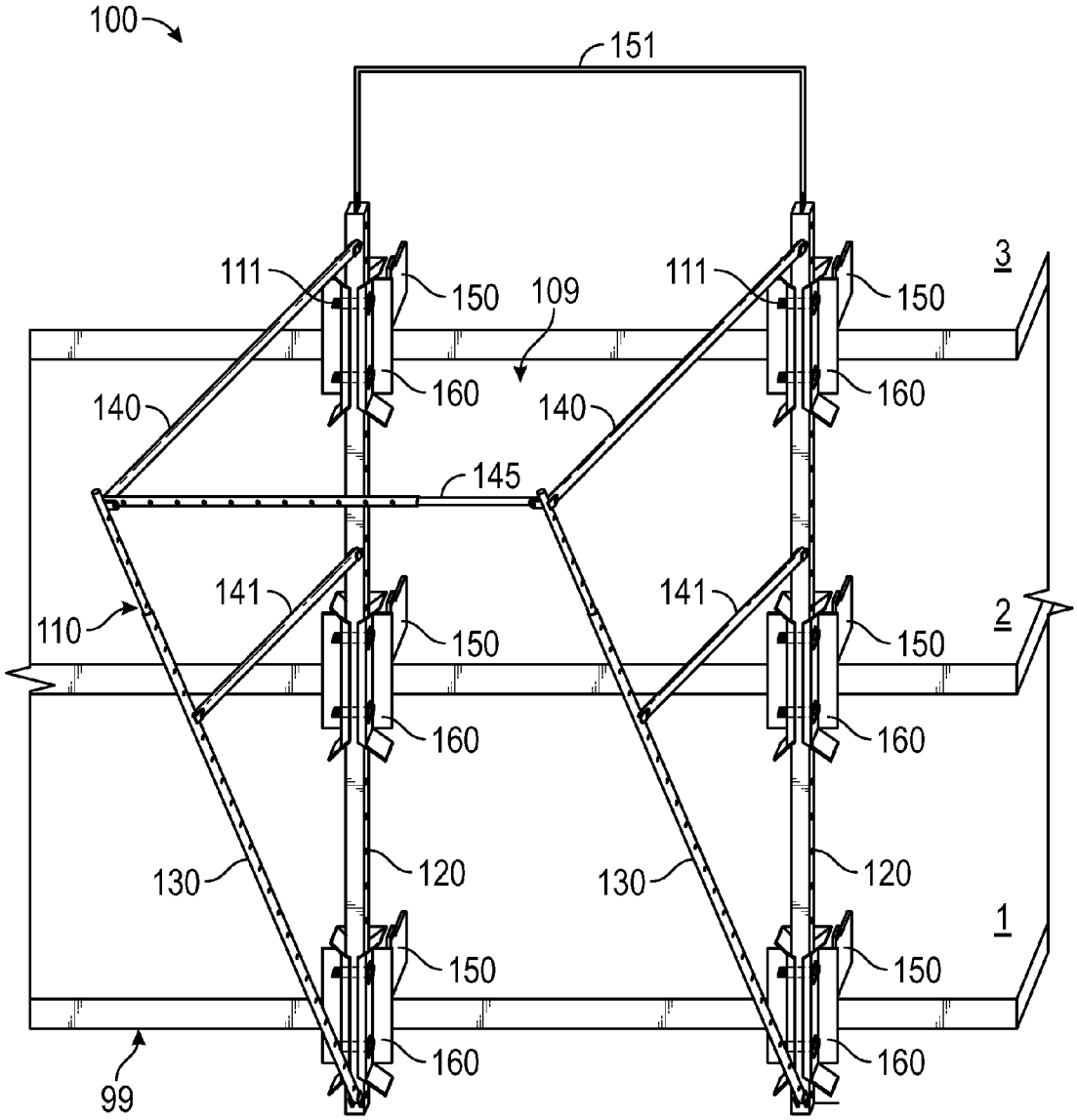
FIG. 1A is a schematic diagram with a perspective view of one embodiment of a construction safety net support apparatus.
Figure 1B:
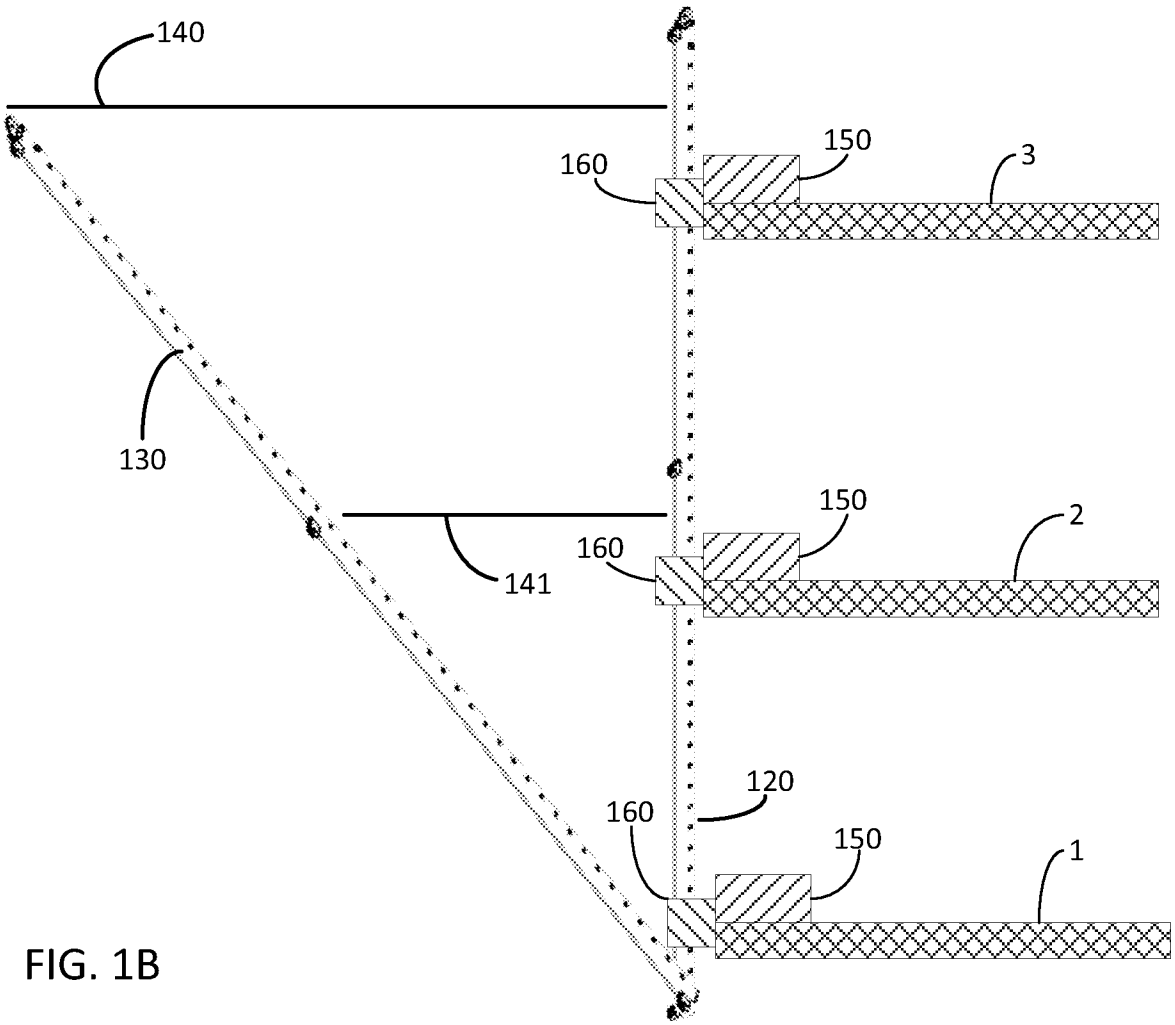
FIG. 1B is a side plan view of the apparatus shown in FIG. 1A.

FIGS. 1A and 1B are schematic diagrams showing a building 99 under construction with exposed floors 1, 2, 3 and one embodiment of a safety net support apparatus 100 attached to the building. The safety net support apparatus 100 includes a frame 110 that is coupled to multiple mounting brackets 150 attached to the building. For example, the mounting brackets 150 may be attached at multiple strategic points on the side of the building as it is raised, or alternatively, attached in corresponding pairs on multiple exposed floors of the building as illustrated in FIG. 1. In the examples described herein, pairs of mounting brackets 150 are attached to multiple floors near the exposed edge, with a channel portion 160 of each bracket sticking out over the exposed edge and into the open space adjacent the building in alignment with corresponding channel portions of the brackets that are attached above and/or below. The frame is configured with a pair of parallel vertical beams 120 that can be secured in position within the channel portions 160 of paired mounting brackets 150, but also released and then simply lifted upward to be secured within the channel portions of mounting brackets on higher floors.

In one embodiment, the channel portions 160 are vertical channels that are integrated with the bracket to extend beyond the edge of the building in alignment with vertical channels of corresponding brackets above and/or below. As noted above, the frame 110 is configured for being moved vertically through the channels 160 of the paired mounting brackets 150, for example, using a crane or a winch and pulley system.

The location of the paired mounting brackets 150 on each floor is selected (i) based on the design width of the frame and netting to be supported; and (ii) such that the channel portions 160 of each bracket are positioned in the open space beyond the edge of the building, in alignment with other channel portions above and/or below. In one embodiment, the paired brackets 150 are spaced apart by approximately 30 feet to accommodate a 30 foot wide frame. Other size frames may be fabricated and used in accord with needs and OSHA regulations. Multiple pairs of brackets may be required on each floor to support multiple frames depending on the building width. The brackets are typically affixed to the floor by bolts, but other methods could be used, such as clamping.

The pair of parallel vertical beams 120 are sized to provide adequate structural support to the frame, and configured to be slideable through the channels 160. The supporting force for the rest of the frame 110 is provided through the connection of the vertical beams 120 to the mounting brackets 150 through the channels 160, and thus the vertical beams will typically be larger structural members than are required for the remaining frame members.

The remaining frame members include a pair of diagonal posts 130 each connected at or near the bottom of respective vertical beams 120; a pair of horizontal posts 140 each coupled at or near the top of respective vertical beams and diagonal posts; and a lateral post 145 coupling the top ends of the horizontal and diagonal posts to form a square or rectangular opening 109 at the top of the frame 110. One or more additional horizontal posts, such as posts 141 coupled between the vertical beams and the diagonal posts in a midway position, may be used to increase and enhance the structural support of the frame 110. A safety net (not shown) is coupled to and supported by the frame 110 in accord with OSHA regulations, for example, by coupling the net at the four points of opening 109, e.g., at each end of the two horizontal posts 140.

The frame 110 and attached netting can be easily moved upward by one or several floors at a time by affixing additional pairs of mounting brackets 150 on the next floor or floors above, then lifting the frame by the vertical beams 120 up into the next set of aligned, paired brackets. For example, the contractor may have extra mounting brackets 150 on hand that can be attached to multiple floors thereby minimizing the need to remove brackets from a lower floor to relocate them to a higher floor.

A locking mechanism 111 is provided for locking and releasing the sliding frame 110 from its position within respective mounting brackets 150. For example, opposite walls of the vertical channel 160 can be provided with horizontal openings, and the vertical beams 120 can be provided with multiple openings along the length of the post that can be horizontally aligned with the openings in the vertical channel, and a pin or other device inserted through the aligned openings to hold the post within the channel.

A lift mechanism 151 can also be provided for raising and lowering the vertical beams 120 into and out of the aligned vertical channels 160. For example, a high-rise building will typically have a crane on-site that can be configured to provide a lifting force for one or more vertical beams 120 (and the corresponding nets). In one embodiment, a cable can be attached to each of the vertical beams, and the crane will lift the cable thereby lifting the beams. Alternatively, a winch and pulley system can be configured to provide the lifting function.

Figure 2:
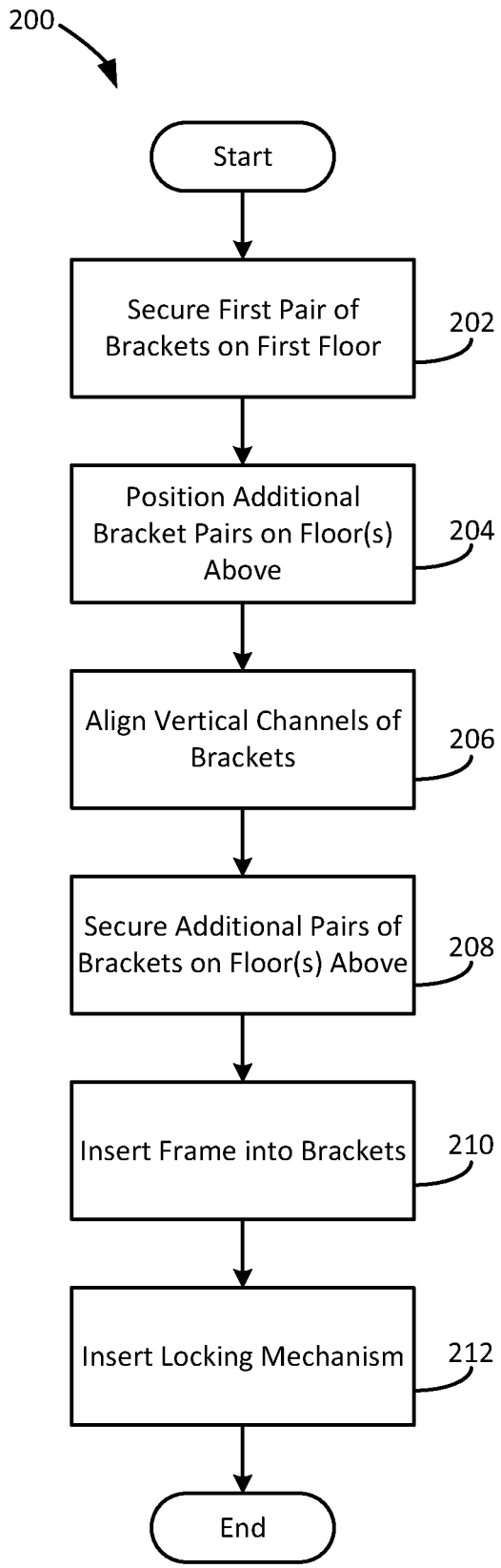
FIG. 2 is a flow chart of a method for using the construction safety net support apparatus of FIG. 1.

FIG. 2 illustrates one method 200 for using the safety net support apparatus 100, for example, on a high-rise construction project. In step 202, a first pair of brackets 150 is secured on a first floor of the building under construction in a spaced-apart relationship, for example, by bolting the brackets to the floor. In the current context, the first floor (or second or third) is intended to be a relative reference and merely exemplary. The first floor may be the ground floor or it may be located above the ground floor. As would be commonly understood, however, the second floor is directly above the first floor, the third floor is directly above the second floor, etc.

In step 204, additional pairs of brackets 150 are positioned on one or more floors above the first floor in correspondence with the paired brackets on the first floor. At least two pairs of brackets 150 are required since the frame 110 must extend across at least two floors, and frequently the frame will extend across three floors. In a typical example, a second pair of brackets 150 is positioned on the second floor in correspondence with the first pair of brackets and a third pair of brackets is positioned on the third floor in correspondence with the first and second pairs of brackets. However, pairs of brackets 150 could be secured on as many floors as there are brackets available, and multiple pairs of brackets may be needed to adequately cover each floor.

In step 206, the vertical channels 160 of the all the brackets 150 that have been positioned in correspondence on multiple floors are aligned. For example, a laser level or other suitable method could be used to accurately align the vertical channels 160 of paired brackets one floor at a time. In step 208, the additional pairs of brackets 150 are secured to their respective floors so that the vertical channels 160 remain aligned. These steps of positioning and securing the brackets 150 may be performed one floor at a time, or multiple floors at a time.

In step 210, the parallel vertical beams 120 of the frame 110 are inserted through the aligned vertical channels 160 of paired mounting brackets 150 affixed on multiple floors. For example, a crane may be used to position the vertical beams 120 of frame 110 above the paired brackets on the top-most floors, and a human operator guides the beams into the vertical channels 160. In step 212, locking mechanisms are inserted through corresponding openings in the channels and vertical beams to secure the beams in position in the channels. In one example, the locking mechanisms are used only on the top-most brackets where the frame is inserted.

In a typical high-rise building construction project, once four floors have been roughed out, the safety nets and their support apparatuses are installed. As additional floors are constructed, additional pairs of brackets are installed, and the frame is moved upward through the vertical channels either one floor at a time or multiple floors at a time.

Figure 3:
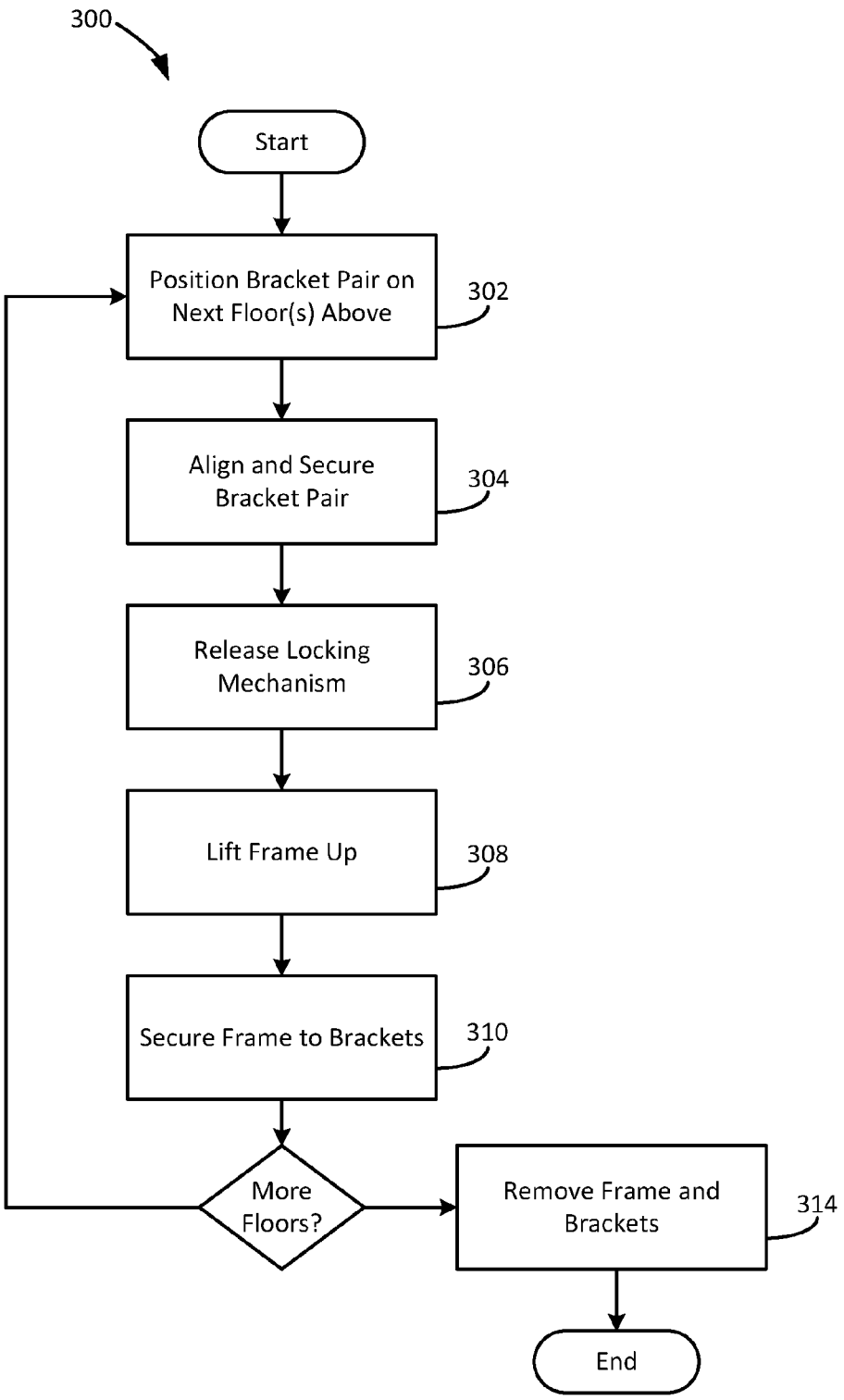
FIG. 3 is a flow chart of another method for using the construction safety net support apparatus of FIG. 1.
Figure 4A:
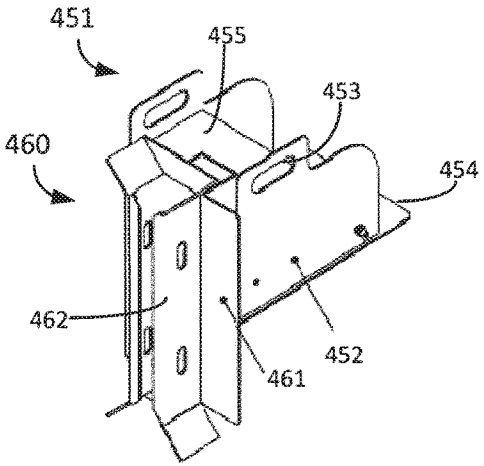
FIGS. 4A-4D are perspective views of the various components for one embodiment of a mounting bracket for use in the safety net support apparatus.
Figure 4B:
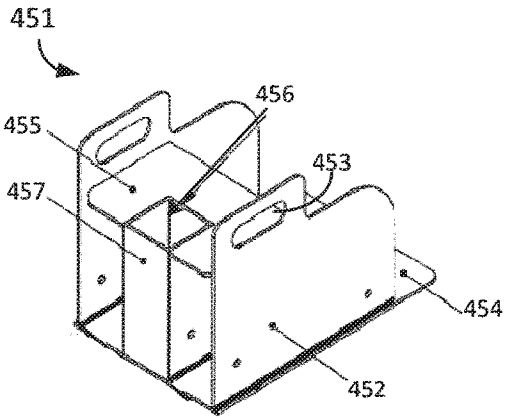
Figure 4C:
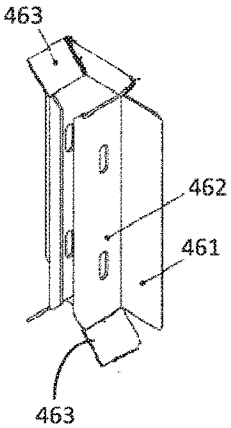
Figure 4D:
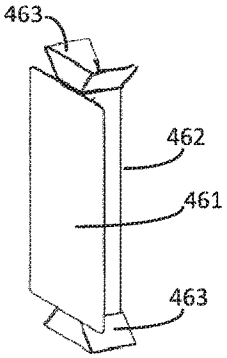

FIG. 3 illustrates one method 300 for raising the safety net support apparatus to service the higher floors as the building increases in height during construction. In step 302, a pair of brackets 150 is positioned on the next floor above the current top pair of brackets. In step 304, the brackets on the next floor are aligned with the brackets on floors below and then secured in position such that the vertical channels are aligned.

In step 306, the locking mechanism 111 is released from the current top pair of brackets thereby allowing the vertical beams 120 of frame 110 to be lifted up through the vertical channels 160. In step 308, the vertical beams 120 are lifted through the vertical channels 160 to a new position in the vertical channels of the paired brackets on the next floor using appropriate mechanical means.

In step 310, the locking mechanism 111 is again engaged to secure the vertical beams 120 to the vertical channels 160 of the paired brackets 150 on the next floor. In step 312, if all floors have been serviced and construction is completed, then the netting and its support apparatus can be removed from the building in step 314. If all floors have not been serviced in step 312, then the method returns to step 302 to move the apparatus up to service the next floor or set of floors.

Additional details of an embodiment of a safety net support apparatus 400 having a configuration similar to that of FIG. 1 will now be described. FIGS. 4A-4D illustrate one embodiment of a mounting bracket assembly 450. The mounting bracket assembly 450 is formed of several discrete components, primarily made from ¼ inch steel plate or equivalent, that may be welded or bonded together to form the mounting bracket assembly, including a vertical channel 460 affixed to the front of a mounting block 451.

The mounting block 451 has two parallel sides 452 each having a handle 453 at the top thereof for lifting and moving the assembled mounting bracket 450. The sides 452 of the mounting block 451 are each respectively welded to a bottom plate 454 and to a middle plate 455. The bottom plate 454 and the middle plate 455 each have a square opening 456 formed in vertical correspondence, and a square channel 457 is formed by welding four identical channel plates together and to the bottom plate and the middle plate at the openings. The square channel 457 is intended to be used for inserting a mating square post (not shown) as part of a winch and pulley assembly into the mounting bracket, as will be described below.

In one embodiment, the mounting block 451 measures approximately 20 inches deep by 16 inches wide by 16 inches tall. The bottom plate 454 is approximately 24 inches deep, and the middle plate 455 is approximately 10 inches deep. The bottom plate 454 includes openings or slots (not shown) for bolting the assembled mounting bracket 450 to the floor. The square channel 457 is approximately 5⅛ inch square, and suitable for receiving a 5 inch square post.

The vertical channel 460 includes a flat plate 461 and a square channel member 462. The flat plate 461 is affixed to the front end of the mounting block 451, and the square channel member 462 is affixed to the flat plate. The square channel member 462 includes flanged edges 463 affixed at the top and bottom thereof to help guide a vertical post into the channel member.

Figure 5A:
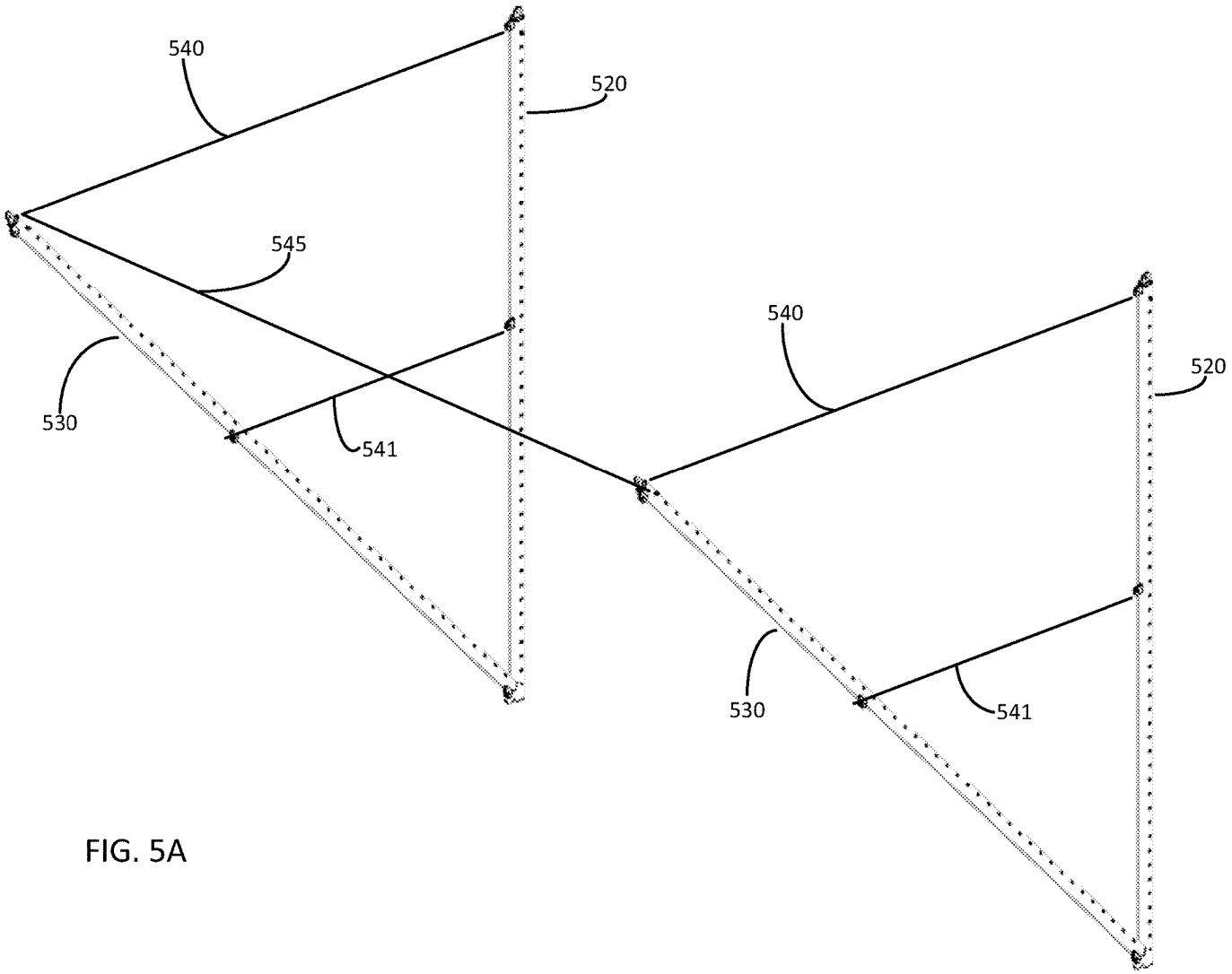
FIG. 5A is a perspective view for one embodiment of a frame for use in the safety net support apparatus.

FIG. 5A shows a portion of one embodiment of a frame assembly 510. A first side of the frame assembly 510 includes a vertical beam 520, a diagonal post 530, a first horizontal post 540, and a second horizontal post 541. The first horizontal post 540 is coupled between the top of the vertical beam 520 and the diagonal post 530. The second horizontal post 541 is coupled between the middle of the vertical beam 520 and the middle of the diagonal post 530.

A second side (not shown) of the frame assembly 510 is identical to the first side. A lateral post 545 couples the first side and the second side together by joining the top of the diagonal post 530 and the end of the first horizontal post 540 to the same point on the identical second side of the frame 510.

The materials used for the various beams and posts of the frame should be round or square steel pipe or equivalent, with sizes and lengths determined by the application in view of OSHA requirements. For example, in one embodiment, a frame having a 30 foot width and a 60 foot length would have the following material specification: the vertical beams 560 are 4 inch square steel pipe or equivalent with a 24 foot length; the diagonal posts 530, the horizontal posts 540, 541 and the lateral posts 545 are 3 inch round steel pipe; the diagonal posts have a 40 foot length; the first horizontal post has a 30 foot length; the second horizontal post has a 15 foot length; and the lateral post has a 30 foot length. In one embodiment, the diagonal posts 530 can be made as a two-part telescoping post (not shown).

Figure 5C:
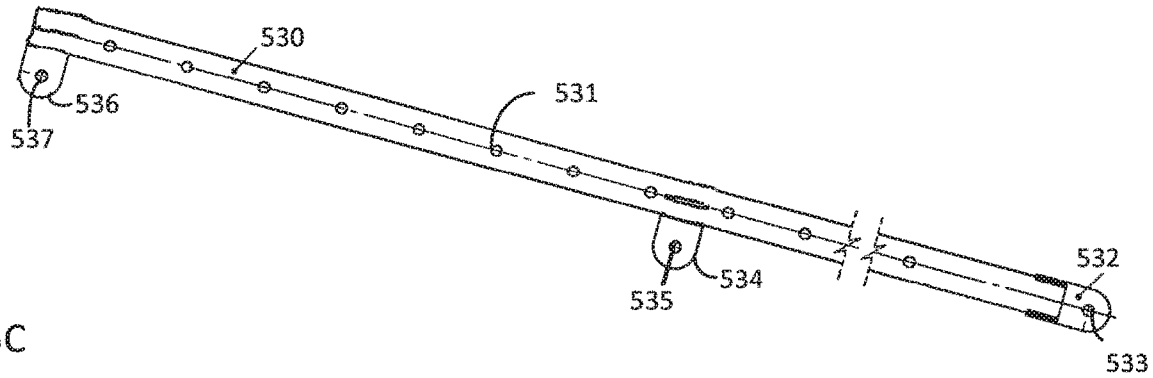
FIG. 5C is a plan view of the diagonal post member of the frame of FIG. 5A.
Figure 5B:
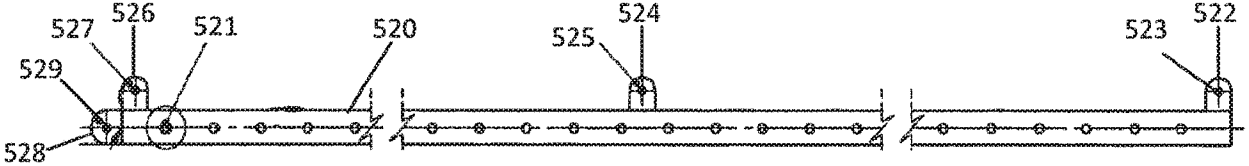
FIG. 5B is a plan view of the vertical beam member of the frame of FIG. 5A.

FIG. 5B illustrates one embodiment of the vertical beam 520. The beam 520 includes a number of holes 521, e.g., ½ inch radius, formed through the beam and disposed along its length. In order to lock the beam 520 in position, a pair of the holes 521 on the beam is horizontally aligned with corresponding openings on the vertical channel of the desired mounting bracket, and a locking mechanism (not shown) is inserted through the corresponding holes/openings to hold the beam in place.

The vertical beam 520 includes a bottom tab 522 having a center hole 523; a middle tab 524 having a center hole 525; and an upper tab 526 having a center hole 527, wherein each of the tabs extend to the side of the beam. The diagonal post 530 is attached to the vertical beam 520 at tab 522. Tabs 524, 526 are where the horizontal posts 540 and 541, respectively, are connected between the diagonal post 530 and the vertical beam 520. A pull tab 528 with center hole 529 is affixed at the very top of the vertical beam 520 and is used for lifting the beam up through the vertical channels of the mounting brackets.

FIG. 5C illustrates one embodiment of the diagonal post 530. Like the vertical beam 520, the diagonal post includes a number of holes 531 formed through the post and disposed along the length of the post so that the post can be affixed in different positions. The diagonal post 530 includes a bottom tab 532 with center hole 533 that is connected, e.g., with a nut and bolt or other fastener, to tab 522 on the vertical beam 520. The diagonal post 530 also includes a middle tab 534 with center hole 535 and upper tab 536 with center hole 537, both tabs extending to one side of the post for connection to the horizontal posts 540, 541.

One embodiment of a unidirectional locking mechanism 600 is illustrated in FIGS. 6A and 6B. The locking mechanism includes a pair of latches 601 having a downward tapered face 602 and an elongated slot 603. The latches are held within a body 604 by a pin 605 that is inserted through the body at through-holes 606 and through the elongated slot 603 on the latch. An spring 607 is held within the body 604 and between the two latches 601 to provide an outward spring bias to the latches. The latching mechanism 600 can be affixed near the top of the vertical beam 520 with the latches 601 extending under bias from the beam into the holes 531 of the vertical channel 560. As the vertical beam 520 is lifted through the vertical channel 560, the latches 602 will be pressed inward against the walls of the vertical channel to allow the beam to travel upwardly. If one attempts to move the vertical beam 520 downward through the vertical channels 560, the non-tapered portion of the latch with not be pushed in, and the locking mechanism will not allow the vertical beam to travel downward.

Figure 7:
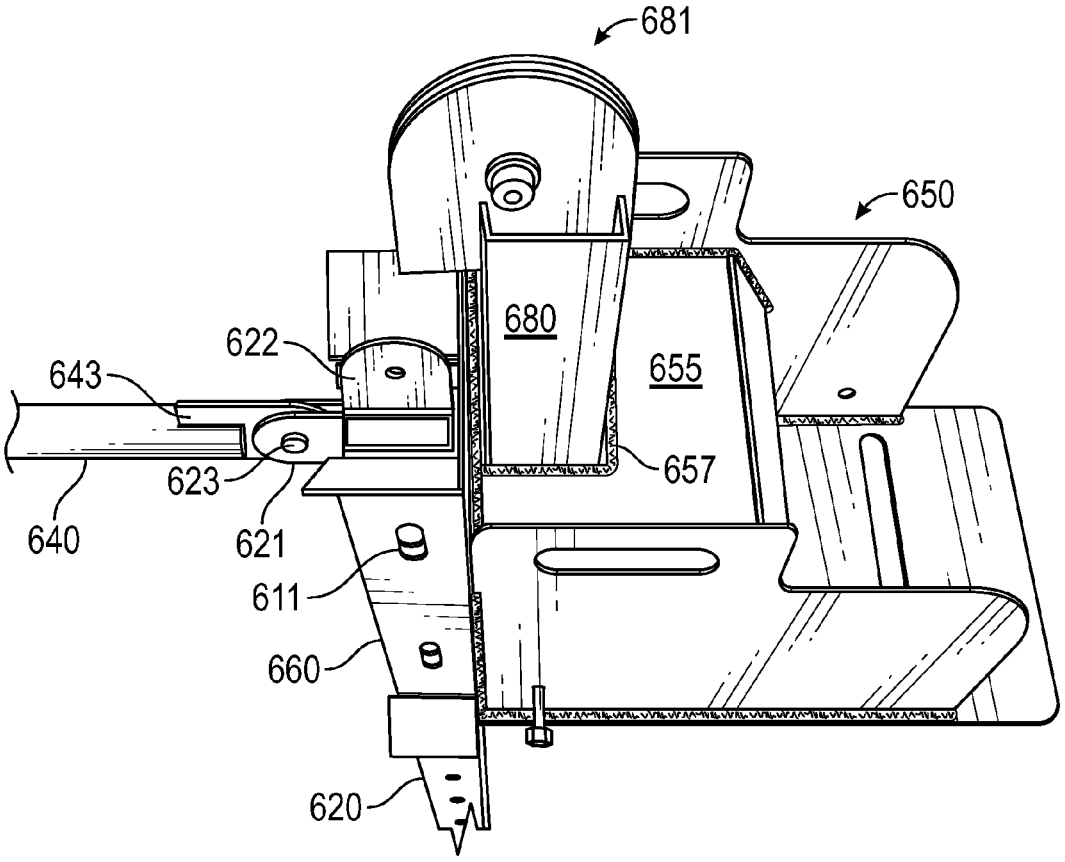
FIG. 7 illustrates a winch and pulley assembly configured to be used with the mounting bracket of FIGS. 4A-4D.

FIG. 7 illustrates one example of a mounting bracket assembly 650 having a square channel 657 affixed at the middle plate 655. The vertical beam 620 is held in place within the vertical channel 660 of the mounting bracket assembly 650 by locking mechanism 611. The vertical beam 620 includes a first tab 621 affixed to extend at a right angle away from the mounting bracket 650, and a second tab 622 affixed to extend straight up from the vertical beam. A horizontal post 640 includes a post tab 643 affixed at the end thereof, and the post tab is coupled to the first tab 621 of the vertical beam 620, e.g., by a fastener 623, to secure the horizontal post to the vertical beam.

A square post 680 is inserted into the square channel 657 of the mounting bracket assembly 650. The square post 680 includes a pulley 681 affixed to the top of the square post. A pulley cable (not shown) can be wrapped around the pulley 681 and one end of the cable fastened to the safety net (not shown). The other end of the cable can be attached to a winch (not shown) in order to raise the safety net to remove any debris or personnel that may have fallen into the net. In another embodiment, the cable may be attached to the tab 622 at the top of the vertical beam 620 in order to lift the beam up through the vertical channel 660, for example, using a winch.

Although illustrative embodiments have been shown and described by way of example, a wide range of alternative embodiments is possible within the scope of the foregoing disclosure.

We claim:

1. A safety net support apparatus for a building under construction, the safety net support apparatus comprising:

a frame configured to define a volume of open space within the frame and to support safety netting, the frame having a plurality of frame members including:

two vertical support posts spaced apart by a first distance in a first parallel relationship, each vertical support post of said two vertical support posts having a length sufficient to span at least two floors of the building under construction, two top horizontal support posts each having a first end and a second end, the first end of each top horizontal support post of said two top horizontal support posts affixed to an upper end of respective ones of the two vertical support posts, and each of the two top horizontal support posts spaced apart by the first distance and extending away from the upper ends of the respective ones of the two vertical support posts in a second parallel relationship, a lateral post affixed to the second end of each of respective ones of the two top horizontal support posts thereby forming a top opening in the frame; and two diagonal posts each having a first end and a second end, the first end of each diagonal post of said two diagonal posts affixed to a bottom end of the respective ones of the two vertical support posts and the second end of each diagonal post affixed to the second end of the respective ones of the two top horizontal support posts;

a plurality of mounting brackets adapted to be affixed in pairs to adjacent floors of the building under construction such that each pair of the mounting brackets is spaced-apart by the first distance and oriented in a third parallel relationship in vertical alignment with pairs of the mounting brackets affixed on adjacent floors, each one of the mounting brackets having a vertical channel portion coupled with a floor mounting portion, the floor mounting portion configured for attachment to a floor near an exposed edge of the building under construction, the vertical channel portion defining a fixed partially enclosed passageway configured to be positioned beyond the exposed edge and held in the volume of open space such that each of the two vertical support posts of the frame is contained by and slideable through the fixed partially enclosed passageway of the vertical channel portion;

a locking mechanism for securing the vertical support posts to at least one pair of the mounting brackets;

a pair of lifting mechanisms each coupled at respective tops of the vertical support posts and configured for raising and lowering the vertical support posts through the fixed passageways of the vertical channel portions of the mounting brackets when the vertical support posts are not secured; and a pair of lifting posts mounted in corresponding receptacles of the mounting brackets, each lifting post being coupled to a corresponding lifting mechanism of the lifting mechanisms.

2. The apparatus of claim 1, the vertical channel portions having at least one horizontal channel opening, and the vertical support posts having a plurality of horizontal post openings, wherein the vertical support posts are positioned such that at least one of the horizontal post openings is aligned with the at least one horizontal channel opening and the locking mechanism is inserted therethrough.

3. The apparatus of claim 2, wherein the locking mechanism is a pin.

4. The apparatus of claim 2, wherein the locking mechanism is a unidirectional mechanism configured to be released upon attempting to move each of the two vertical support posts upward through respective ones of the vertical channel portions and not released upon attempting to move each of the respective vertical support posts downward through the respective ones of the vertical channel portions.

5. The apparatus of claim 1, wherein each of the pair of lifting mechanisms is a winch and pulley assembly.

6. The apparatus of claim 1, each of the mounting brackets further comprising a pair of handles.

7. The apparatus of claim 1, the frame further comprising:

a plurality of additional horizontal support posts affixed at different locations between the vertical support posts and the diagonal posts.

8. A safety net support apparatus for a building under construction, the safety net support apparatus comprising:

a frame configured to define a volume of open space within the frame and to support safety netting, the frame having a plurality of frame members including:

two vertical support posts oriented spaced apart by a first distance in a first parallel relationship, each vertical support post of the two vertical support posts having a length sufficient to span at least two floors of the building under construction, two top horizontal support posts each having a first end and a second end, the first end of each top horizontal support post of the two top horizontal support posts affixed to an upper end of respective ones of the two vertical support posts, and each of the two top horizontal support posts spaced apart by the first distance and extending away from the upper ends of the respective ones of the two vertical support posts in a second parallel relationship, a lateral post affixed to the second end of each of respective ones of the two top horizontal support posts thereby forming a top opening in the frame; and at least two additional posts each having a first end and a second end, the first end of each additional post affixed near a bottom end of the respective ones of the two vertical support posts and the second end of each additional post affixed to the second end of the respective ones of the two top horizontal support posts;

a plurality of mounting brackets arranged in pairs, each pair of the mounting brackets configured to be affixed in a third parallel relationship spaced apart by the first distance at or near an edge of an exposed floor of the building in vertical alignment with other pairs of the mounting brackets affixed on adjacent floors;

a plurality of vertical channels each affixed to a respective one of the mounting brackets and configured to extend beyond the edge of the exposed floor and be held in the volume of open space, each of the plurality of vertical channels defining a fixed partially enclosed passageway such that each of the two vertical support posts of the frame is contained by and slideable through the fixed partially enclosed passageway of respective ones of the vertical channels;

a pair of lifting mechanisms each coupled at respective tops of the two vertical support posts and configured for raising and lowering each of the two vertical support posts through the fixed passageways of the respective vertical channels when the respective vertical support posts are not secured; and a pair of lifting posts mounted in corresponding receptacles of the mounting brackets, each lifting post being coupled to a corresponding lifting mechanism of the lifting mechanisms;

wherein when the two vertical support posts of the frame are secured within the respective ones of the vertical channels of the mounting brackets affixed on adjacent floors, the frame is configured to be moved upward to service additional floors by lifting the two vertical support posts through the respective ones of the vertical channels.

9. The apparatus of claim 8, further comprising:

a locking mechanism for securing the vertical support posts of the frame to at least one pair of the mounting brackets.

10. The apparatus of claim 8, further comprising a lifting mechanism configured to lift the two vertical support posts through the vertical channels of the mounting brackets.

11. A method for supporting and securing a safety net with the safety net support apparatus of claim 1, the method comprising:

providing the apparatus of claim 1;

affixing a first pair of the mounting brackets to a first floor;

affixing a second pair of the mounting brackets to a second floor;

inserting the vertical posts into the first and second pairs of the mounting brackets; and, securing the vertical posts to the second pair of the mounting brackets.

* * * * *